US006015028A

United States Patent [19]

Smith

[11] Patent Number: 6,015,028

[45] Date of Patent: Jan. 18, 2000

[54] PUMP JACK HOISTING APPARATUS INCLUDING A SAFETY RAILING FOR PROTECTING WORKERS FROM ACCIDENTAL FALLING

[76] Inventor: Andrew C. Smith, 1541 Park Rd., Harrisonburg, Va. 22801

[21] Appl. No.: 08/855,957

[22] Filed: May 14, 1997

[51] Int. Cl.[7] ..... E04G 1/18

[52] U.S. Cl. ..... 182/136; 182/113; 182/146

[58] Field of Search ..... 182/133, 136, 182/113, 146

[56] References Cited

U.S. PATENT DOCUMENTS

| | | | |
|---|---|---|---|
| 1,616,743 | 2/1927 | Ericsson . | |
| 3,747,896 | 7/1973 | Warren . | |
| 3,867,997 | 2/1975 | Hyslop, Jr. . | |
| 4,236,698 | 12/1980 | Compte . | |
| 4,276,959 | 7/1981 | Barber . | |
| 4,598,794 | 7/1986 | Anderson . | |
| 4,641,728 | 2/1987 | McCabe | 182/146 |
| 4,666,131 | 5/1987 | Kettelkamp | 182/113 |
| 4,673,060 | 6/1987 | Gregory . | |
| 5,307,899 | 5/1994 | Lubinski . | |
| 5,314,167 | 5/1994 | Holloman . | |
| 5,638,917 | 6/1997 | Vennen . | |

FOREIGN PATENT DOCUMENTS

| | | | |
|---|---|---|---|
| 814167 | 6/1969 | Canada | 182/113 |
| 1507714 | 12/1967 | France | 182/113 |
| 414126 | 12/1966 | Switzerland | 182/53 |
| 1579240 | 11/1980 | United Kingdom | 182/145 |

OTHER PUBLICATIONS

Aberdeen's Magazine of Masonry Construction, Oct. 1996, vol. 9, No. 10, p. 455.

Alum–A–Pole Corporation 1985 Brochure (2 pages).

*Primary Examiner*—Alvin Chin-Shue
*Attorney, Agent, or Firm*—Dinesh Agarwal, P.C.

[57] ABSTRACT

A pump jack hoisting apparatus includes a safety railing for protecting workers from accidental falling. The apparatus includes a pair of laterally spaced pump jack poles each of which is associated with a respective pump jack. Each pump jack includes inner and outer support extensions for supporting thereon inner and outer walking platforms. A pair of generally L-shaped support frames is removably secured to the outer support extension of the respective pump jack. Each support frame includes a vertically extending arm and a horizontally extending brace. The brace includes a mounting member for engaging the outer arm of the respective pump jack. A plurality of generally L-shaped rail brackets are vertically spaced on the arms and include a top-open recess. A safety rail is removably positioned in the recess and extends between the pair of support frames.

7 Claims, 2 Drawing Sheets

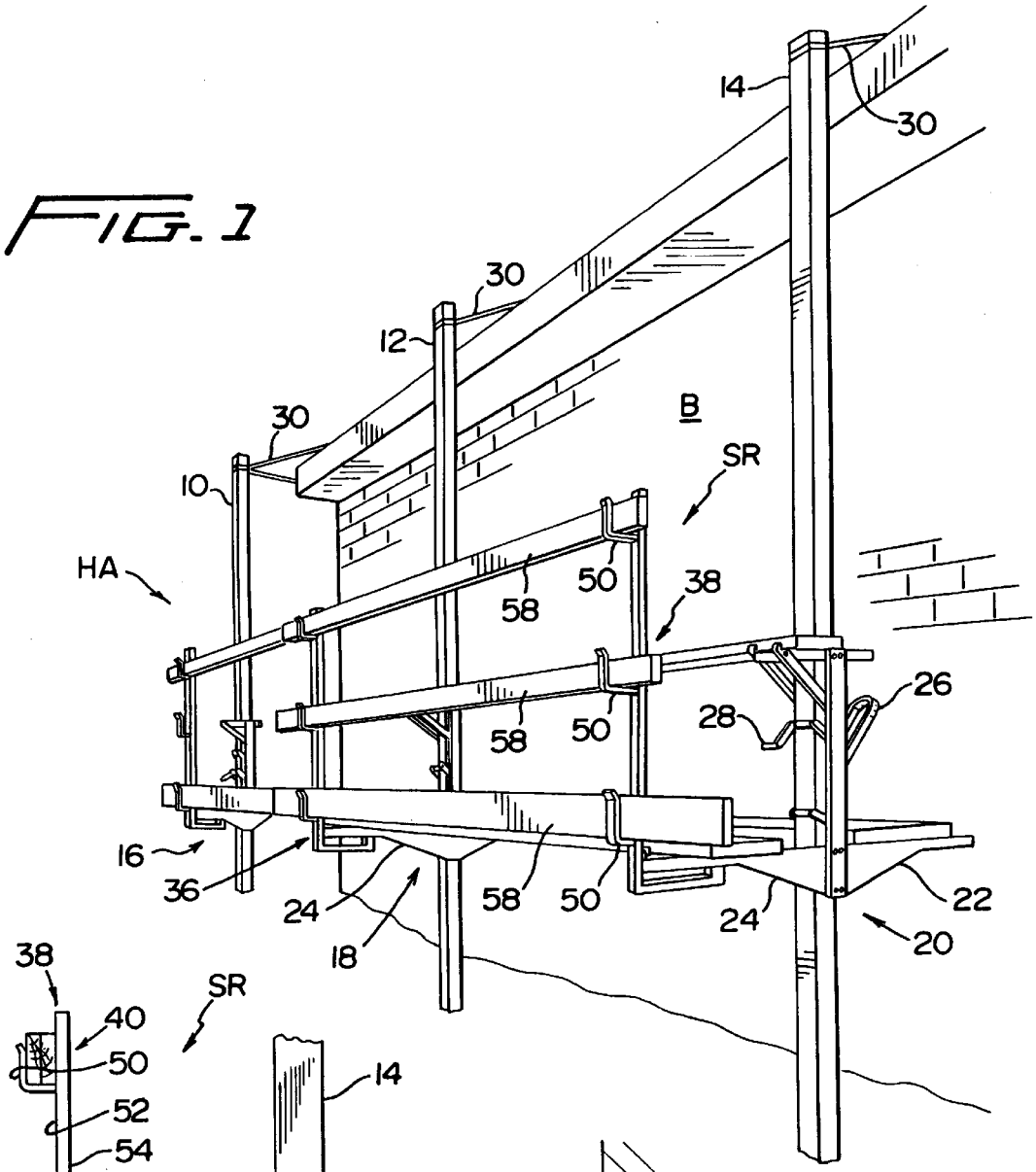
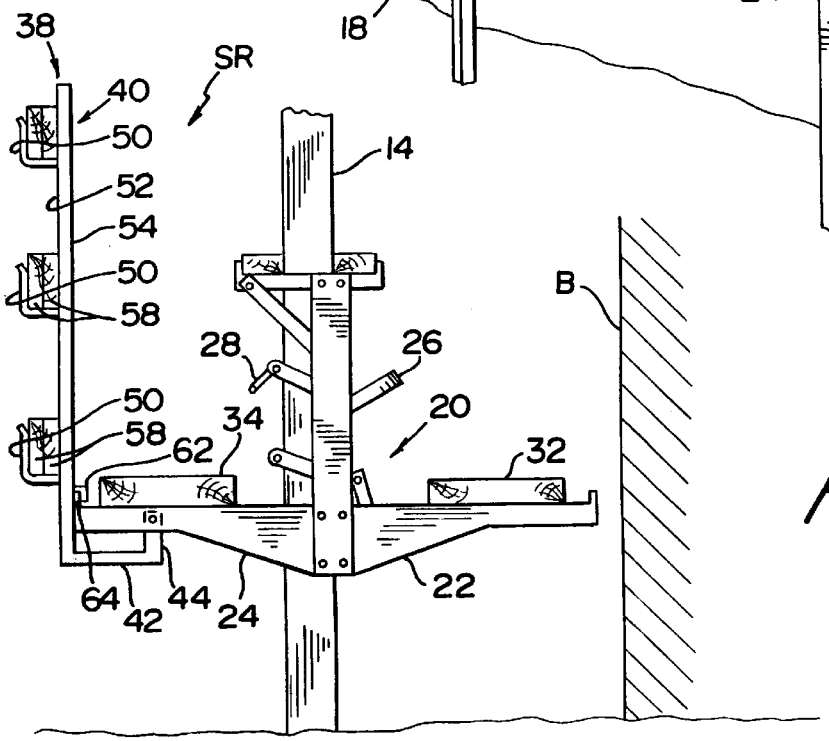
FIG. 2

PUMP JACK HOISTING APPARATUS INCLUDING A SAFETY RAILING FOR PROTECTING WORKERS FROM ACCIDENTAL FALLING

FIELD AND HISTORICAL BACKGROUND OF THE INVENTION

The present invention is directed to a hoisting apparatus, and more particularly to a pump jack hoisting apparatus which includes a safety railing for protecting the workers from accidental falling.

In building industry, it is common to erect scaffolding in relation to the structure being built or worked on in order to allow workers to stand at an elevation above the ground surface. A scaffolding system may be utilized, for example, in the installation of aluminum siding on the exterior of a new or existing house. Scaffolding systems of various nature are also utilized in the construction of high-rise, multistory and other types of commercial buildings. The scaffolding system used in connection with the construction of a multistory building, however, is typically self-standing and is generally known as "tower scaffolding". The scaffolding system utilized in connection with the residential housing, on the other hand, is generally erected by utilizing a pump jack system, which is secured in a spaced relationship to the house, and is typically supported in some fashion by the house or the building structure being built, repaired or maintained.

Pump jack systems are known in the industry. In particular, a pump jack system normally includes a pair of uprights or poles each of which includes a pump jack operably connected thereto. The pump jacks typically include inner and outer support arms or extensions (outriggers) for supporting a work platform for the workers to stand thereon. The pump jacks also include pedal operated cranks to elevate the platform on the pump jack poles and often have hand-operated cranks that permit lowering of the platform. The workers standing on the platforms can easily operate the pump jacks to move the platform up and down along the pump jack poles.

As noted above, a pump jack system relies on the building structure for support. In other words, since the inner platform is generally close to the building structure, there generally is no risk for the workers standing on the inner platform of accidental falling. Such is not the case, however, for the workers standing or working on the outer platform. Typically, pump jack systems are not equipped with any types of safety railing either on the edge of the inner platform or on the edge of the outer platform. Since the inner platform is adjacent to the building structure, there has not therefore been a need to provide a railing on the inner platform. There is, however, a need for providing a safety railing on the edge of the outer platform since there is no structure of any kind which would prevent the workers from accidentally falling off from the outer platform.

Although many scaffolding systems and railings for use in connection with various building structures have been proposed in the art, none is specifically directed to or has the configuration and structure for use in connection with a pump jack system. Examples of varies conventional scaffolding systems and railings are disclosed in U.S. Pat. Nos. 3,747,898; 3,867,997; 4,236,698; 4,276,959; 5,307,899; 4,598,794; and 5,314,167.

OBJECTS AND SUMMARY OF THE INVENTION

The principal object of the present invention is to provide a pump jack hoisting apparatus which includes a safety railing for protecting workers from accidental falling.

One object of the present invention is to provide a safety railing for protecting workers from accidental falling when standing on a pump jack type of hoisting apparatus.

An additional object of the present invention is to provide a safety railing for protecting workers from accidental falling which can be easily mounted to a pump jack type of hoisting apparatus.

Yet an additional object of the present invention is to provide a safety railing for protecting workers from accidental falling which can be easily retrofitted to existing or new pump jack type of hoisting apparatus.

Still yet an additional object of the present invention is to provide a safety railing for protecting workers from accidental falling which can be easily and inexpensively made and is easy to use at a job site.

A further object of the present invention is to provide a safety railing for protecting workers from accidental falling in which the rail support brackets are mounted on the outside of the railing thereby providing an unobstructed work space between the pump jack poles and the safety railing.

Still a further object of the present invention is to provide a safety railing for protecting workers from accidental falling in which the rails can be easily replaced without requiring much down time.

In summary, the main object of the present invention is to provide a pump jack hoisting apparatus which includes a safety railing for protecting workers from accidental falling, which railing is easy to use, inexpensive to manufacture, can be retrofitted to existing pump jack systems, and which provides safety to workers at above ground height.

BRIEF DESCRIPTION OF THE DRAWINGS

The above and other objects and novel features of the present invention will be apparent from a review of the detailed description of the invention provided below and as illustrated in the drawings, in which:

FIG. 1 is a perspective view of the pump jack hoisting apparatus including a safety railing for protecting workers from accidental falling in accordance with the present invention;

FIG. 2 is an enlarged end elevational view of the apparatus shown in FIG. 1;

DETAILED DESCRIPTION OF THE INVENTION

Figure 5:
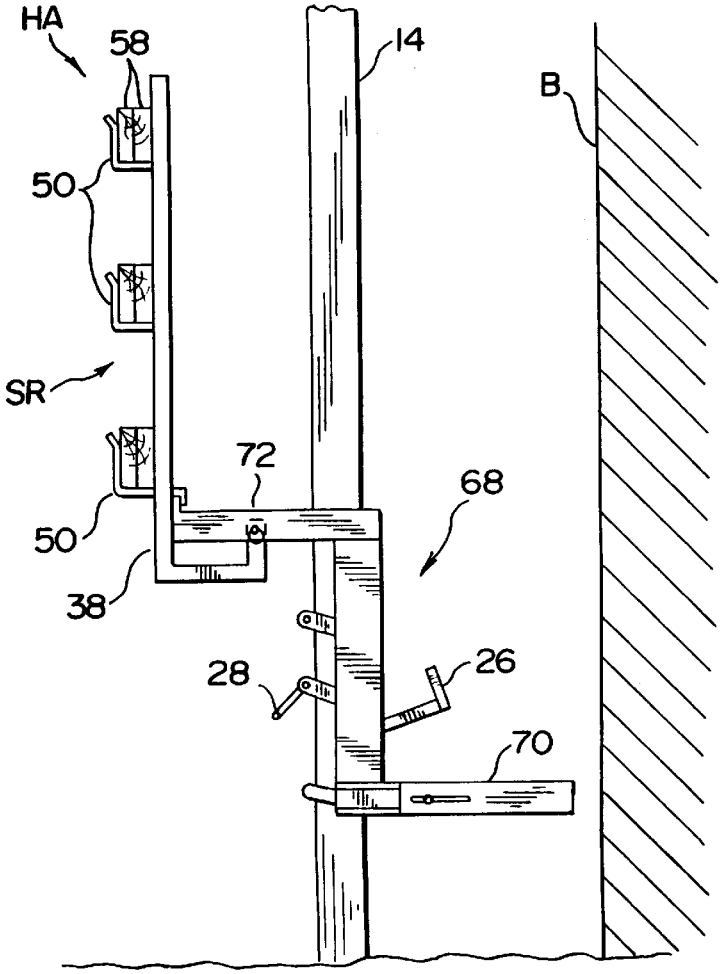
FIG. 5 is an end elevational view of an alternative embodiment of the pump jack hoisting apparatus including a safety railing.

As best shown in FIG. 1, the pump jack hoisting apparatus HA of the present invention, shown mounted on the side of a building structure B, includes laterally spaced pump jack poles 10, 12 and 14. Each pole 10, 12 and 14, includes a pump jack 16, 18 and 20, respectively, slidably mounted thereon. Each pump jack 16, 18 and 20 includes inner and outer support extensions 22 and 24, respectively. The pump jacks are those conventionally available and each includes a toe pedal 26 for raising the hoisting apparatus HA and a hand crank 28 for lowering thereof. As shown in FIG. 1, pump jack poles 10, 12 and 14 are secured in place by tying metal braces 30 to a rigid part of the building structure B, in a known fashion. (It is noted herewith that although three pump jacks riding on three pump jack poles are illustrated in the drawings, it is only necessary that two pump jacks with two corresponding poles be provided.)

As best shown in FIG. 2, both inner and outer support extensions 22 and 24 extend in a generally common plane and therefore ride up and down the corresponding jack pole together. The inner support extensions 22 of pump jacks 16 and 18, support a walking platform 32 which can be made of a conventionally suitable material, such as a wooden board. (It should be noted that while one single board has been shown to serve as the platform, it is well within the scope of this invention to provide a plurality of narrow boards, such as 2×4) Likewise, the outer support extension 24 of pump jacks 18 and 20, support an outer walking platform 34.

As best shown in FIGS. 1–2, a safety railing SR is provided on the outer support extensions 24 of pump jacks 18 and 20. The safety railing SR includes a pair of generally L-shaped support frames 36 and 38. As best shown in FIG. 2, support frame 38 includes a vertically extending arm 40 and a horizontally extending brace 42. (It should be noted that both support frames 36 and 38 are similar in construction and are mounted similarly. Therefore, description is hereby made only in respect to frame 38 for clarity.)

Figure 3:
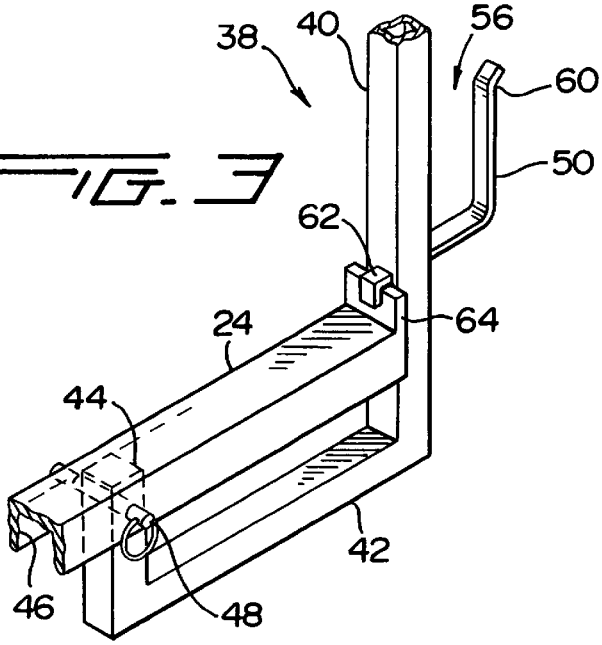
FIG. 3 is a partial enlarged perspective view of the railing of the present invention, shown mounted to a pump jack support extension.

As best shown in FIGS. 2 and 3, an upwardly extending mounting extension 44 extends into channel 46 of outer support extension 24. In order to immobilize support frame 38 in extension 24, a lock-pin 38 is inserted through aligned holes in extension 24 and mounting member 44.

As further shown in FIGS. 2 and 3, generally L-shaped rail brackets 50 are mounted on the exterior side 52 of arm 40. It is noted herewith that exterior side 52 of arm 40 faces away from pump jack 20 and interior side 54 faces directly thereto.

As best shown in FIG. 3, each rail bracket 50 defines a top-open recess 56 for receiving and removing rails 58. Preferably, each rail 58 is a 2×4 wooden plank. (It should be noted herewith that other types of rails may also be used without departing from the scope and spirit of the invention.) As best shown in FIG. 2, typically recess 56 is wide enough to accommodate the overlapping ends of rails 58. In other words, the length of each rail 58 need not be more than the distance between the laterally spaced support frames 36 and 38, and by overlapping the ends of rails at or near brackets 50, a railing system of an infinite length may be produced. Although not shown, holes may be provided in brackets 50 and rails 58 to insert therethrough a pin to lock rails in brackets.

As best shown in FIG. 3, tip 60 of rails is slightly bent outwardly for facilitating insertion and removal of rails 58.

As shown in FIGS. 2 and 3, on the interior 54 of arm 40 is provided a catch bracket 62, which engages upward flange 64 of support extension 24. The provision of interlocking engagement of catch bracket 62 and upward flange 64 on one hand, and the immobilization of extension 44 in channel 46 by lock pin 48, on the other hand, provides stability and mounting integrity to support frame 38 on the pump jack mechanism.

Figure 4:
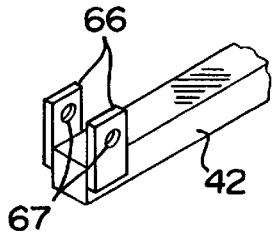
FIG. 4 is an alternative embodiment of the mounting member of the railing.

FIG. 4 illustrates an alternative embodiment of mounting support frame 38 to the pump jack support extension 24. In particular, instead of an upwardly extending extension 44, brace 42 is provided with two laterally spaced projections 66 which embrace the outside of support extension 24. Each projection 66 is provided with a hole 67, which is aligned to receive lock pin 48.

An alternative embodiment of the pump jack hoisting apparatus HA is illustrated in FIG. 5, which is similar to the embodiment enclosed in FIG. 1–4, with the exception that pump jack 68 includes vertically offset inner and outer platforms 70 and 72, respectively. In other words, the pump jack mechanism and safety railing SR are the same except that the inner and outer platforms extend in different horizontal planes.

As noted above, conventional pump jack systems are not equipped with any type of railing either on the inner or the outer platform. The safety railing SR of the invention was designed with this deficiency in mind. In particular, the safety railing SR of the invention can be easily mounted to an existing pump jack mechanism, as shown herein in the drawings, by first mounting two L-shaped support frames 36 and 38, on the corresponding outer support extensions 24 of two jacks 18 and 20. Once the frames 36 and 38 are locked in place by inserting pin 48 in mounting extension 44 and support extension 24, rails 58 can be positioned in recesses 56 of brackets 50. The safety railing SR can be easily removed by following these steps in the reverse order.

As can be readily seen from FIG. 2, since the brackets 50 are mounted on the exterior of arm 40, workers are provided with an unobstructed area between pump jacks and the safety railing SR.

As can be seen from the above detailed description of the invention, the novel pump jack hoisting apparatus of the present invention can be easily used to provide safety to the workers from accidental falling, and can be easily retrofitted to existing pump jack mechanisms.

While this invention has been described as having a preferred design, it is understood that it is capable of further modifications, uses and/or adaptations following in general the principle of the invention, and including such departures from the present disclosure as those come within the known or customary practice in the art to which the invention pertains, and as may be applied to the central features hereinsetforth, and fall within the scope of the invention and the limits of the appended claims.

What is claimed is:

1. A pump jack hoisting apparatus for use in connection with low-rise and residential constructions and buildings including a safety railing for protecting workers from accidental falling, comprising:

a) a pair of laterally spaced pump jack poles each including a brace adjacent one end thereof for securing to a building or construction;

b) a pair of pump jacks each operably associated with the respective jack pole of said pair of jack poles;

c) each of said pump jacks including inner and outer support extensions;

d) inner and outer walking platforms spanning between said pair of pump jacks and supported on respective inner and outer support extensions thereof;

e) said inner and outer platforms extending in a generally common plane;

f) a pair of generally L-shaped support frames each removably secured to said outer support extension of said respective pair of pump jacks;

g) each of said pair of a generally L-shaped support frames including a vertically extending arm and a horizontally extending brace;

h) each said horizontally extending brace including an upwardly extending mounting projection member engaging the outer support extension of said respective pump jack means for locking each of said pair of generally L-shaped support frames to respective outer support extensions, said means for locking comprising lock pins releasably locking the projection members to respective outer support extensions, and a catch member on each vertically extending arm engaging a flange on respective outer support extensions;

i) first, second and third vertically equidistantly spaced rail brackets mounted on each of said arms;

j) each of said rail brackets being generally L-shaped and including a top-open recess;

k) said rail brackets being vertically spaced on each of said respective vertically extending arms;

l) a rail removably positioned in said recess and extending between said pair of a generally L-shaped support frames;

m) each of said vertically extending arms including a first side facing said brace and a second side facing away therefrom; and n) said rail brackets being mounted on said second side of said arms vertically extending.

2. The hoisting apparatus of claim 1, wherein:

a) said upwardly extending mounting projection member comprises a generally U-shaped member.

3. The hoisting apparatus of claim 1, wherein:

a) at least one of said support frames is made of a solid metal bar.

4. The hoisting apparatus of claim 1, wherein:

a) at least one of said support frames is made of a generally tubular material.

5. In combination with a pump jack hoisting system for use in connection with low-rise and residential constructions and buildings, a safety railing for protecting workers from accidental falling, the pump jack hoisting system including a pair of laterally spaced pump jack poles, each of said pump jack poles including a brace adjacent one end thereof for securing to building or construction, a pair of pump jacks each operably associated with the respective jack pole, each pump jack including inner and outer support extensions for supporting inner and outer walk platforms spanning between the pump jacks, the safety railing comprising:

a) a generally L-shaped support frame removably secured to the outer support extension of each pump jack;

b) said support frame including a vertically extending arm and a horizontally extending brace;

c) said horizontally extending brace including an upwardly extending mounting projection member for engaging the outer support extension of the respective pump jack;

d) a plurality of rail brackets vertically spaced on said vertically extending arm;

e) each of said rail brackets being generally L-shaped and including a top-open recess;

f) a rail removably positioned in said recess and extending between said pump jacks;

g) a lock pin interlocking said upwardly extending mounting projection member to the outer support extension of the respective pump jack; and a catch member on said vertically extending arm interlocking the arm with a flange on the outer support extension;

h) said vertically extending arm including a first side facing said horizontally extending brace and a second side facing away therefrom; and i) said rail brackets being mounted on said second side of said vertically extending arm.

6. The hoisting apparatus of claim 5, wherein:

a) said inner and outer support extensions extend in vertically offset planes.

7. The safety railing of claim 5, wherein:

a) said upwardly extending mounting projection member comprises a generally U-shaped member.

* * * * *